US007806702B2

(12) United States Patent
Aihara et al.

(10) Patent No.: US 7,806,702 B2
(45) Date of Patent: Oct. 5, 2010

(54) CONNECTOR FOR AN ELECTRIC DEVICE SUCH AS A BOARD

(75) Inventors: Tetsuya Aihara, Yokkaichi (JP); Kenji Okamura, Yokkaichi (JP); Masahide Hio, Yokkaichi (JP); Yoshiro Kakuda, Toyota (JP); Hiroshi Kobayashi, Okazaki (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/604,790

(22) Filed: Oct. 23, 2009

(65) Prior Publication Data

US 2010/0112836 A1 May 6, 2010

(30) Foreign Application Priority Data

Nov. 4, 2008 (JP) ..... 2008-283486

(51) Int. Cl.
*H01R 12/00* (2006.01)

(52) U.S. Cl. ..... 439/79; 439/570; 439/574; 439/575

(58) Field of Classification Search ..... 439/79, 439/565, 570, 574, 575
See application file for complete search history.

(56) References Cited

U.S. PATENT DOCUMENTS 5,893,764 A * 4/1999 Long ..... 439/79
6,790,052 B2 * 9/2004 Schmidgall et al. ..... 439/79
7,134,910 B2 11/2006 Nakano et al.
2006/0068620 A1 * 3/2006 Okamura et al. ..... 439/79

FOREIGN PATENT DOCUMENTS

| | | |
|---|---|---|
| JP | 11-067374 | 3/1999 |
| JP | 2004-031259 | 1/2004 |
| JP | 2004-214093 | 7/2004 |
| JP | 2005-317357 | 11/2005 |

* cited by examiner

*Primary Examiner*—Tho D Ta
(74) *Attorney, Agent, or Firm*—Gerald E. Hespos; Michael J. Porco

(57) ABSTRACT

A board connector (10) has a housing (20) with a terminal holding portion (40) for holding terminals (30) in forward and backward directions and a receptacle extends forward from the terminal holding portion (40). Mount grooves (60) are formed in side walls (52) of the receptacle (50). Board fixing portions (70) are held in the mount grooves (60) within the thickness range of the side walls and are soldered to the upper surface of a printed board (P). Mounting portions (54) are formed in the side walls (52) and have open front ends. Restricting members (80) are formed separately from the mating connector and mountable within the thickness range of the side walls (52) forward of the board fixing portions (70). One end of each restricting member (54) engages lower surfaces (54A) of the mounting portions (54) and the other end engages the lower surface of the printed board (P).

13 Claims, 8 Drawing Sheets

CONNECTOR FOR AN ELECTRIC DEVICE SUCH AS A BOARD

BACKGROUND OF THE INVENTION

1. Field of the Invention

The invention relates to a connector for an electric device such as a board connector to be fixed to a board e.g. by soldering.

2. Description of the Related Art

Japanese Unexamined Patent Publication No. 2004-214093 discloses a board connector with a hook integrally formed on a housing. The hook projects down from a lower surface of the housing and then extends back. The board connector is fixed to a surface of a board by sandwiching an end edge of the board between the hook and the lower surface of the housing. This construction enlarges the entire housing.

Japanese Unexamined Patent Publication No. H11-67374 discloses a board connector with a fixing clamp. The fixing clamp has a press-fitting portion to be press-fit into a housing, a fixing leg to be fixed to a board and a connecting portion connecting the press-fitting portion and the fixing leg. The press-fitting portion is press-fit into the housing and the fixing leg is inserted into a mount hole in the board to fix the board connector to a surface of the board. The fixing clamp has a complicated structure and the mount hole has to be formed in the board.

Japanese Unexamined Patent Publication No. 2004-31259 discloses a board connector with a housing made of resin and a metallic shield case. The housing is arranged to surround connection terminals. The shield case has locking pieces for fixing a board. With such a construction, the locking pieces are parts of the shield case and only application to a board connector provided with a shield case is possible.

Japanese Unexamined Patent Publication No. 2005-166491 discloses a board connector with mount grooves formed in side walls of a housing and plate-like fixing parts mounted in the mount grooves within the thickness range of the side walls. With such a construction, the entire housing is not enlarged because the fixing parts are arranged within the thickness range of the side walls. Further, the fixing parts have a simple construction and the board connector can be fixed to a board by soldering the fixing parts to a surface of the board. Hence there is no need to form mount holes in the board. This construction is also applicable to a board connector with no shield case.

The soldered parts of the board connector disclosed in Japanese Unexamined Patent Publication No. 2005-166491 are subjected directly to stresses if a wire drawn out backward from a mating connector is vertically shaken while the board connector is connected with the mating connector. Therefore, there is a likelihood of reducing joint strength due to cracks in the soldered parts.

As a countermeasure, Japanese Unexamined Patent Publication No. 2005-317357 discloses a board connector with a receptacle that permits a mating connector to be fitted therein and the mating connector includes a hook-shaped restriction. The restriction engages the underside of a board while sandwiching the board together with the front edge of the receptacle. The restriction is subjected to stress if a wire drawn out backward from the mating connector is shaken vertically, thereby reducing stress on soldered parts.

However, the restriction in Japanese Unexamined Patent Publication No. 2005-317357 is subjected directly to an external force from the mating connector if the wire is vertically shaken and the restriction is more likely to vertically move together with the mating connector. Further, the board is more likely to move vertically if the restriction is moved vertically. Then, other parts mounted on the board are affected adversely even if stresses acting on the soldered parts can be reduced.

Further, the restriction disclosed in Japanese Unexamined Patent Publication No. 2005-317357 is engaged with the underside of the board upon connecting the two connectors. For example, even if the board connector is pulled away from the board surface before a connecting operation, stresses acting on the soldered parts cannot be reduced.

The invention was developed in view of the above situation and an object thereof is to reduce stresses acting on soldered parts before and after a connecting operation by preventing vertical movements of a board.

DETAILED DESCRIPTION OF THE PREFERRED EMBODIMENTS

The invention relates to a connector connectable with a mating connector while the connector is fixed to a fixing surface of an electric device. The connector has a housing with a terminal holding portion for holding one or more terminals and a receptacle projects from the terminal holding portion. At least one mount groove is formed in a side wall of the housing. At least one first fixing part is to be held in the mount groove within the thickness range of the side wall and is to be fixed to the fixing surface of the electric device. At least one mounting portion is formed in the side wall and has an open front. At least one second fixing part is formed separately from the mating connector and is to be mounted in the thickness range of the side wall. One end of the second fixing part is engageable with a surface of the mounting portion toward the electric device and the other end is engageable with the surface of the electric device opposite the fixing surface.

The second fixing part preferably is to be mounted within the thickness range of the side wall before the first fixing part.

The electric device preferably is a board and the first fixing part preferably is to be soldered to the upper surface of the board. The second fixing part preferably has one end engageable with a lower surface of the mounting portion and the other end engageable with the lower surface of the board.

The housing first is fixed to the upper surface of the board by engaging the first fixing part in the mount groove and then soldering the first fixing part to the upper surface of the board. The opposite ends of the second fixing part then are engaged with the lower surface of the mounting portion and the lower surface of the board to fix the front edge of the receptacle to the upper surface of the board. In this state, the front edge of the receptacle can be prevented by the second fixing part from being separated from the upper surface of the board when receiving a force in such a direction away from the upper surface of the board. Further, the second fixing part efficiently prevents the front edge of the receptacle from being separated from the upper surface of the board when a wire drawn out backward from the mating connector is shaken vertically while the board connector and the mating connector are connected. The second fixing part is provided separately from the mating connector. Hence, the mating connector does not subject the second fixing part directly to an external force that could move the board vertically. Therefore, the board will not move vertically and stress on a soldered connection of the first fixing part is reduced.

The rear end of the first fixing part may at least partly overlap with the terminal holding portion in forward and backward directions. Thus, the first fixing part directly fixes the terminal holding portion and the terminals held in the terminal holding portion are not subjected to a force. On the other hand, the first fixing part becomes less able to prevent separation of the front edge of the receptacle from the upper surface of the board as the first fixing part is moved closer to the terminal holding portion. However, the second fixing part fixes the front edge of the receptacle, so that the entire housing is fixed efficiently.

The second fixing part may have two facing portions that substantially face each other and a connecting portion connecting ends of the facing portions. Thus, the second fixing part can be formed easily.

The receptacle may include a bottom wall to be held at least partly in contact with the fixing surface of the electric device or the upper surface of the board, two side walls projecting up from opposite lateral sides of the bottom wall and a ceiling connecting the upper ends of the side walls. Thus, the receptacle is a substantially rectangular tube can be formed.

The first and second fixing parts may be arranged for each of the pair of side walls. Accordingly, the entire housing can be fixed in a well-balanced manner.

The side walls may have substantially the same thickness as the sum of the thickness of the corresponding portion of the electric device and that of the bottom wall.

The front end of the second fixing part may contact the rear end of the mounting portion.

At least one slit having an open lower side may be formed in a lower part of the first fixing part.

These and other features and advantages of the invention will become more apparent upon reading the following description of preferred embodiments and accompanying drawings.

DETAILED DESCRIPTION OF THE PREFERRED EMBODIMENTS

Figure 1:
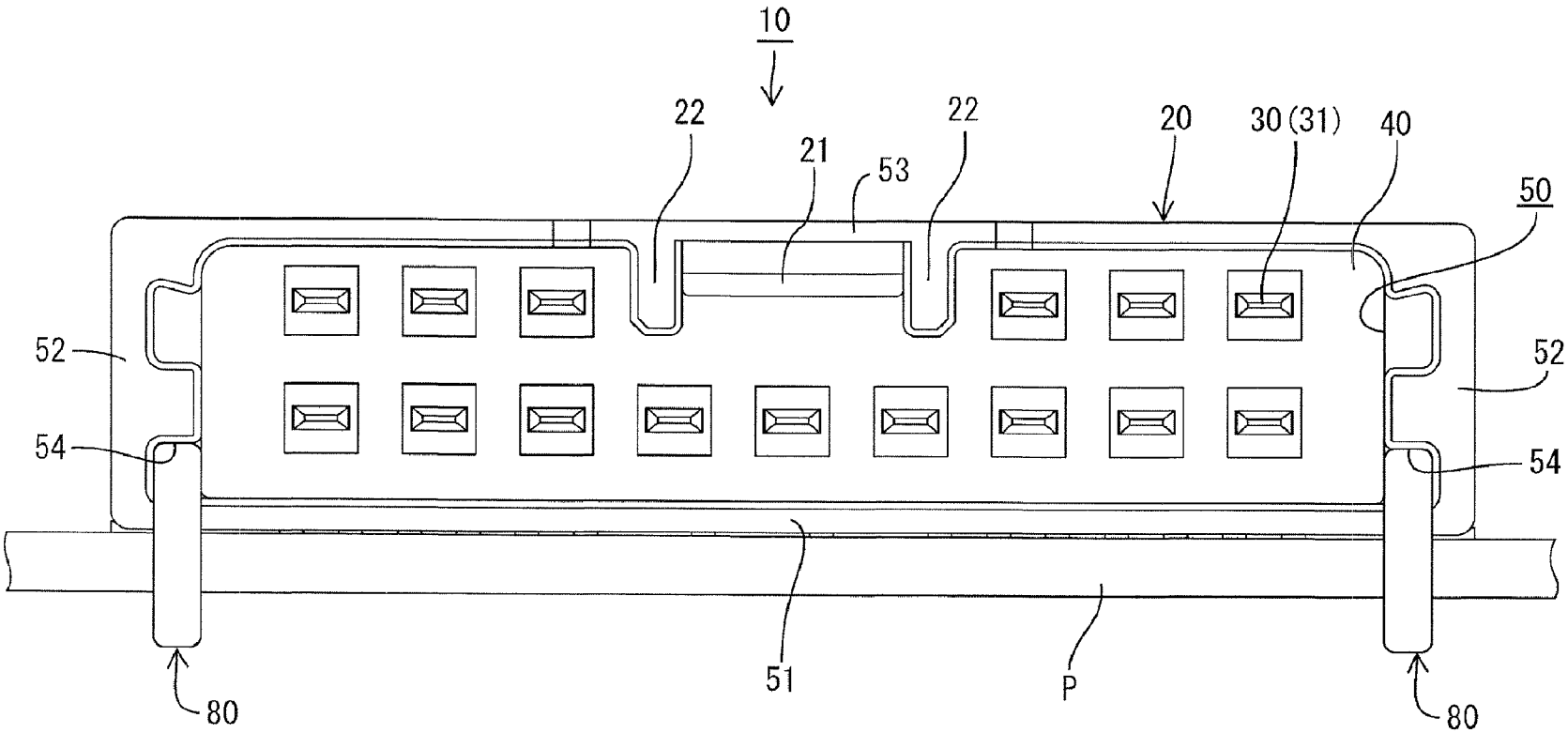
FIG. 1 is a front view showing a state where a board connector is fixed to the upper surface of a printed board.

A board connector in accordance with the invention is identified by the numeral 10 in FIGS. 1 to 8. The board connector 10 in this embodiment is a surface-mount board connector to be mounted on the upper or fixing surface of a printed board P as a preferred electric or electronic device as shown in FIG. 1. However, the invention is applicable to electric or electronic devices other than printed circuit boards, such as junction boxes, computer elements, gear box connectors, electrical motor connectors, etc, The board connector 10 is to be accommodated at least partly in a case (not shown) while being fixed to the upper or fixing surface of the printed board P. In this state, the board connector 10 is connectable with a mating connector (not shown) outside the case. In the following description, connecting directions of the board connector 10 and the mating connector are referred to as forward and backward directions and ends thereof to be connected are referred to as front ends.

Figure 2:
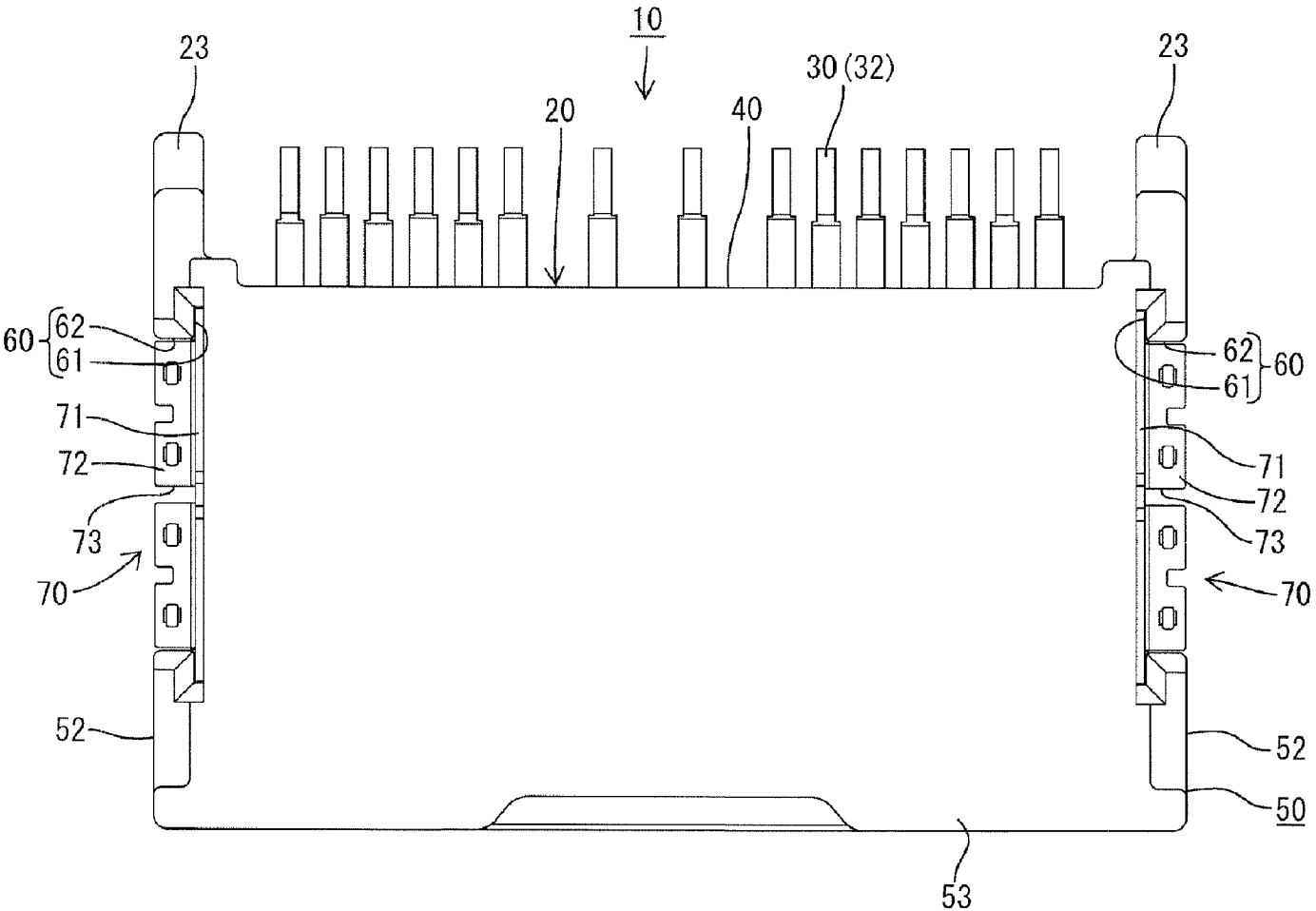
FIG. 2 is a plan view of the board connector.

The board connector 10 includes a housing 20 made e.g. of synthetic resin. The housing 20 has terminals 30, a terminal holding portion 40 for holding the terminals 30 and a rectangular tubular receptacle 50 for at least partly surrounding the terminals 30. As shown in FIG. 2, mount grooves 60 are formed by recessing at the opposite widthwise sides of the housing 20. Fixing portions 70 are held in the mount grooves 60. The board fixing portions 70 are soldered, welded or bolted to fixing lands (not shown) formed on the upper surface of printed board P.

Figure 7:
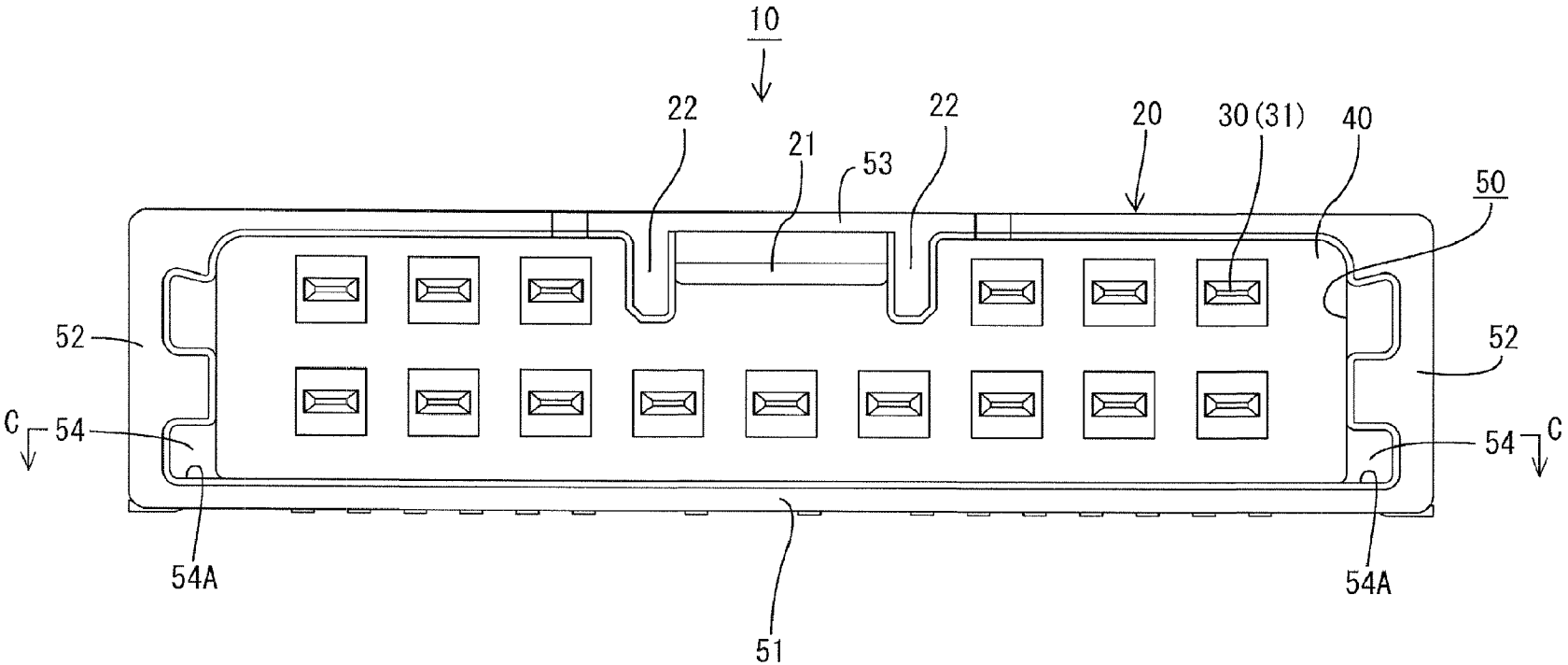
FIG. 7 is a front view of the board connector.
Figure 8:
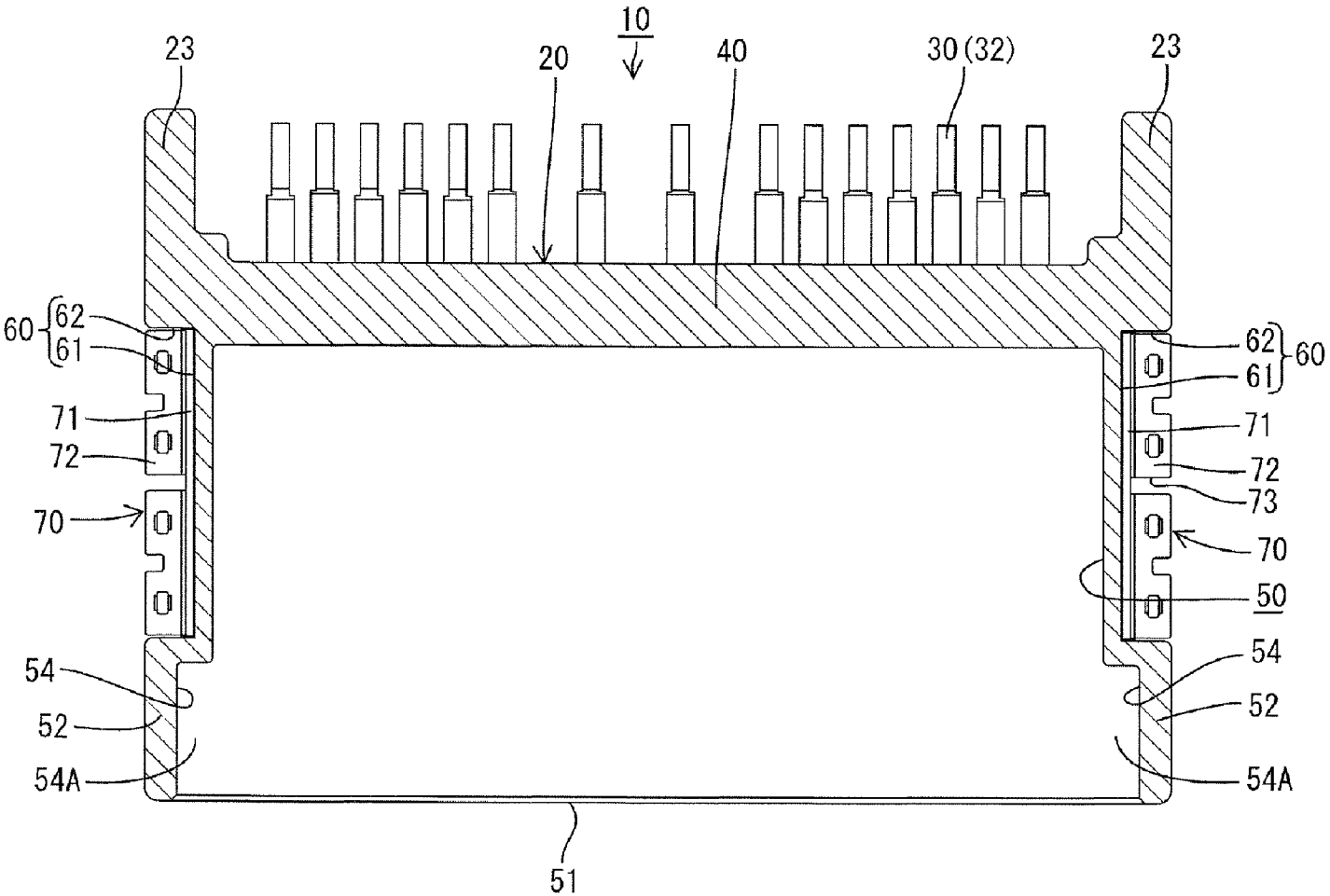
FIG. 8 is a section along C-C of FIG. 7.

As shown in FIGS. 7 and 8, the terminal holding portion 40 is a wide block. Terminals 30 are arranged in the width direction in upper and lower levels in the terminal holding portion 40. Specifically, six terminals 30 are arranged in the upper level and nine terminals 30 are arranged in the lower level. No terminal 30 is arranged in a central part of the upper level corresponding to the central three terminals 30 of the nine terminals 30 in the lower level. The absence of terminals 30 in the central part of the upper level permits entry of a lock arm (not shown) on the mating connector when connecting the two connectors. A lock 21 is provided in the central part of the upper level of the housing 20 and engages the lock arm for holding the two connectors in a properly connected state. Guide ribs 22 extend in forward and backward directions at the opposite widthwise sides of the lock 21 for guiding a connecting operation of the two connectors.

Press-fitting holes (not shown) penetrate the terminal holding portion 40 in forward and backward directions and the terminals 30 are press-fit therein. Front end sides 31 of the terminals 30 project forward from the terminal holding portion 40 and extend to positions so that the front ends of the terminals 30 are behind the front edge of the receptacle 50. On the other hand, rear ends 32 of the terminals 30 are bent substantially perpendicularly down toward the upper surface of the printed board P at positions rearward of the terminal holding portion 40 and are bent again to extend back along the upper surface of the printed board P, as shown in FIG. 2. The rearwardly extending rear ends of the terminals 30 are soldered to connection lands (not shown) on the upper surface of the printed board P to achieve electrical connections. Protection walls 32 are provided at the opposite widthwise sides of the rear end of the housing 20 to protect the rear ends 32 of the terminals 30.

The receptacle 50 extends forward from the outer periphery of the terminal holding portion 40, as shown in FIG. 1. The receptacle 50 has a bottom wall 51 held substantially in contact with the upper surface of the printed board P. Two opposed side walls 52 project up from the opposite lateral edges of the bottom wall 51 and a ceiling wall 53 connects upper parts of the side walls 52. The bottom wall 51 and the ceiling wall 53 are thinner than the side walls 52. On the other hand, the side walls 52 have substantially the same thickness as the sum of the thicknesses of the printed board P and the bottom wall 51. The lock 21 and guide ribs 22 are provided in a widthwise central part of the inner surface of the ceiling wall 53 and the protection walls 23 project back from the side walls 52.

As shown in FIG. 2, the mount grooves 60 penetrate the side walls 52 vertically and reduce the thicknesses of the side walls over a specified extension. On the other hand, each board fixing portion 70 is formed by cutting or punching a conductive metal plate out into a specified shape and bending the cut- or punched-out metal piece. The board fixing portion 70 includes a main body 71 in the form of a flat vertical plate and a soldering portion 72 that projects perpendicularly from the bottom end of the main body 71. Thus, the board fixing portion 70 is substantially L-shaped when viewed in forward and backward directions. The soldering portion 72 is soldered on a fixing land of the printed board P. Escaping grooves 63 are recessed in each mount groove 60 at the front and rear sides of the soldering portion 72 and excess solder flows into the escaping grooves 63 during soldering.

Figure 5:
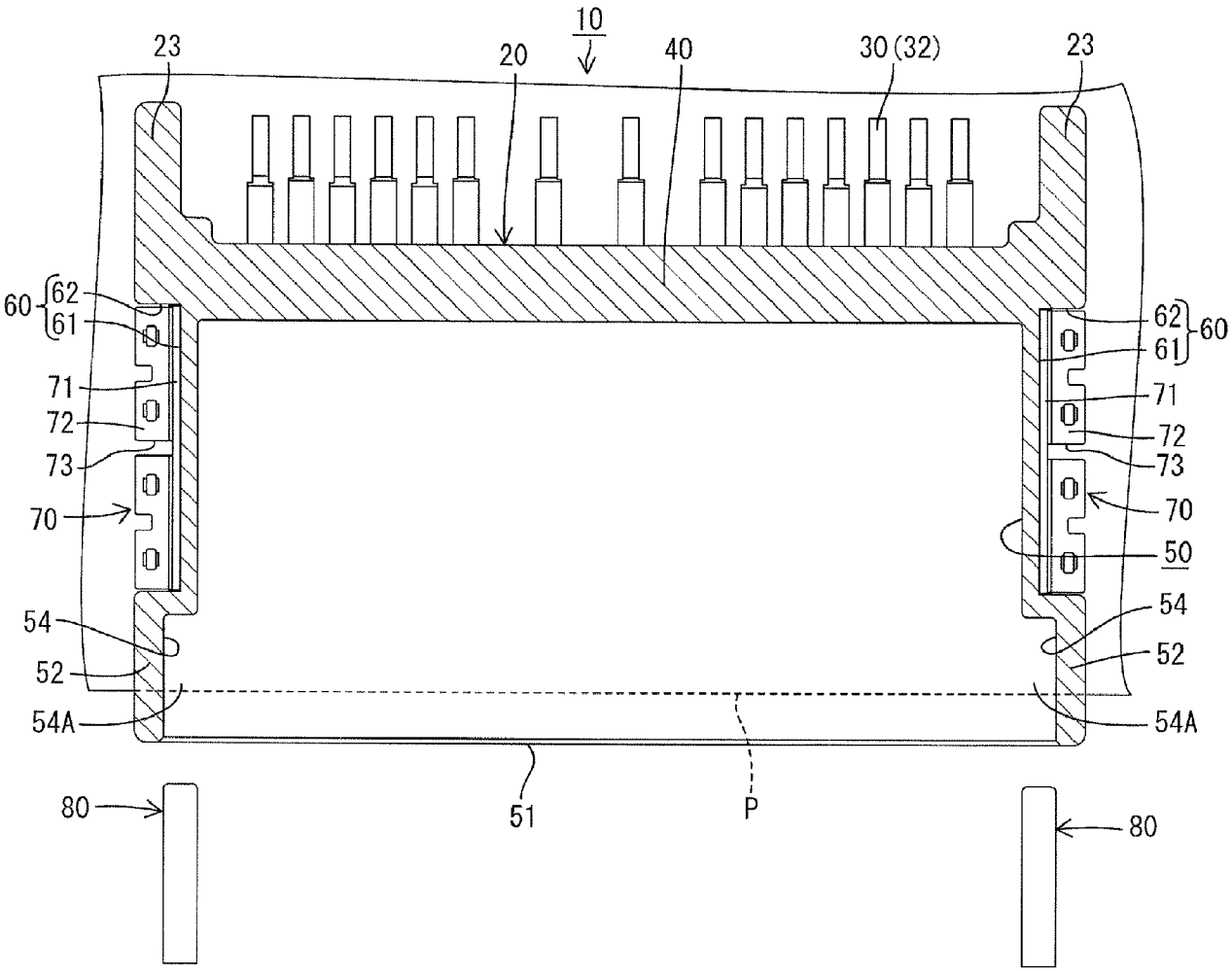
FIG. 5 is a section along A-A of FIG. 3.

As shown in FIG. 5, the rear ends of the mount grooves 60 overlap with the terminal holding portion 40 in forward and backward directions. Thus, the board fixing portions 70 held in the mount grooves 60 also at least partly overlap with the terminal holding portion 40 in forward and backward directions. Thus, the terminal holding portion 40 can be fixed directly by the board fixing portions 70 so that the terminals 30 held in the terminal holding portion 40 are not subjected to a force.

Each mount groove 60 has a main-body accommodating portion 61 for receiving the main body 71 of the board fixing portion 70 along a plate surface direction thereof and a soldering-portion accommodating portion 62 for receiving the soldering portion 72 along a direction substantially orthogonal to a plate surface direction thereof. The soldering-portion accommodating portion 62 is open sideways toward the outer surface of the side wall 52. The escaping grooves 63 are formed by obliquely cutting the bottom end corners of the soldering-portion accommodating portion 62. In this way, the mount groove 60 is formed within the thickness range of the side wall 52. Further, the board fixing portion 70 held in the mount groove 60 also is arranged within the thickness range of the side wall 52.

Figure 3:
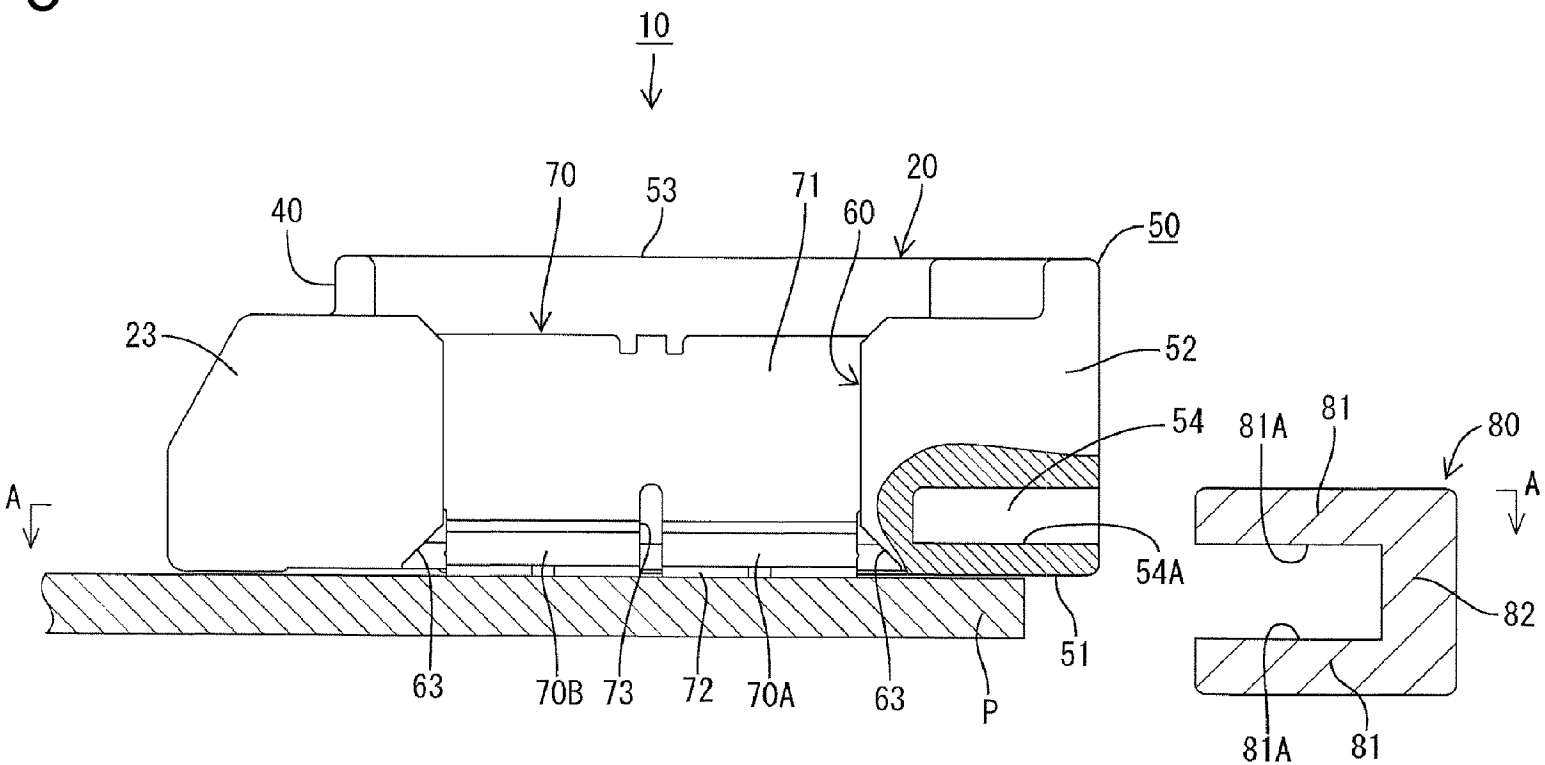
FIG. 3 is a side view partly in section of the board connector showing a state before restricting members are mounted.

As shown in FIG. 3, a downwardly open slit 73 is formed in a lower part of the board fixing portion 70 and divides a lower part of the main body 71 and the soldering portion 72 into a front leg 70A and a rear leg 70B. Accordingly, the front legs 70A move away from the upper surface of the printed board P, if the front edge of the receptacle 50 receives a force in a direction away from the upper surface of the printed board P. On the other hand, stress on the soldering portions 72 is reduced in the rear legs 70B due to opening deformations of the slits 73. Conversely, stress on the soldering portions 72 of the rear legs 70B are reduced if the rear edge of the receptacle 50 (terminal holding portion 40) receives a force in a direction away from the upper surface of the printed board P.

The restricting members 80 are formed separately from the mating connector and are mountable to the front ends of the side walls 52. As shown in FIG. 3, each restricting member 80 includes two opposed facing portions 81 and a connecting portion 82 connecting ends of the facing portions 81. On the other hand, mounting portions 54 are formed in the front surfaces of the side walls 52 and are engageable with the facing portions 81.

Each mounting portion 54 opens in both front and inner surfaces of the corresponding side wall 52. Facing surfaces 81A of the facing portions 81 engage a lower surface 54A of the mounting portion 54 and the lower surface of the printed board P when the upper facing portion 81 is fit into the mounting portion 54. As shown in FIGS. 7 and 8, the lower surface 54A of the mounting portion 54 is continuous and flush with the inner surface of the bottom wall 51. A spacing between the facing surfaces 81A is equal to or slightly smaller than the sum of the thicknesses of the bottom wall 51 and the printed board P. Accordingly, a part between the lower surface 54A of the mounting portion 54 and the lower surface of the printed board P is held tightly by the facing portions 81 when the restricting member 80 is mounted with the board connector 10 is mounted to the upper surface of the printed board P, as shown in FIGS. 3 and 4.

Figure 6:
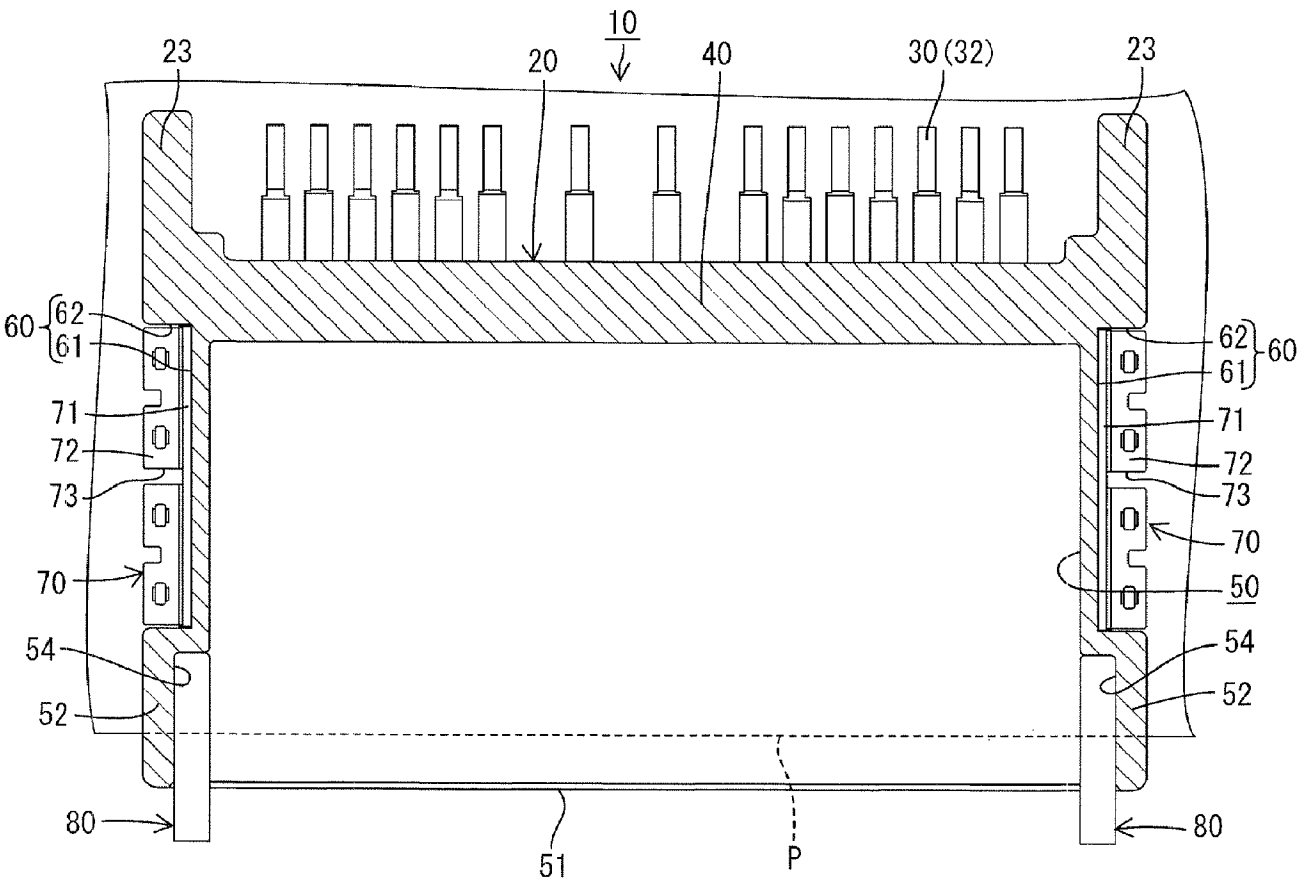
FIG. 6 is a section along B-B of FIG. 4.

As shown in FIG. 5, the mounting portions 54 are arranged before the mount grooves 60 and are within the thickness range of the side walls 52. As shown in FIG. 6, the thickness of the restricting members 80 equals the width of the mounting portions 54. Thus, the restricting members 80 mounted in the mounting portions 54 also are arranged in the thickness range of the side walls 52. Hence, the mounting portions 54 need not be formed separately from the side walls 52 and the housing 20 is not enlarged. Further, the restricting members 80 are provided separately from the mating connector, and there is no likelihood that the restricting members 80 are subjected to an external force from the mating connector to vertically move the printed board P, for example, if a wire drawn out backward from the mating connector is shaken vertically at the time of connecting the two connectors. Therefore, other parts mounted on the printed board P are not affected adversely.

The board connector 10 is assembled initially by mounting the board fixing portions 70 into the mount grooves 60. The board connector 10 then is placed at a specified position on the upper surface of the printed board P. On the other hand, liquid solder paste (not shown) is applied to the fixing lands and the connection land of the printed board P and the soldering portions 72 and the rear ends 32 of the terminals 30 are placed on the fixing lands and the connection land from above via the solder paste. Reflow soldering then is performed with the board connector 10 and other parts placed on the printed board P. Thus, the soldering portions 72 are soldered and fixed to the fixing lands and the rear ends 32 of the terminals 30 are soldered to the connection lands to be electrically connected.

Figure 4:
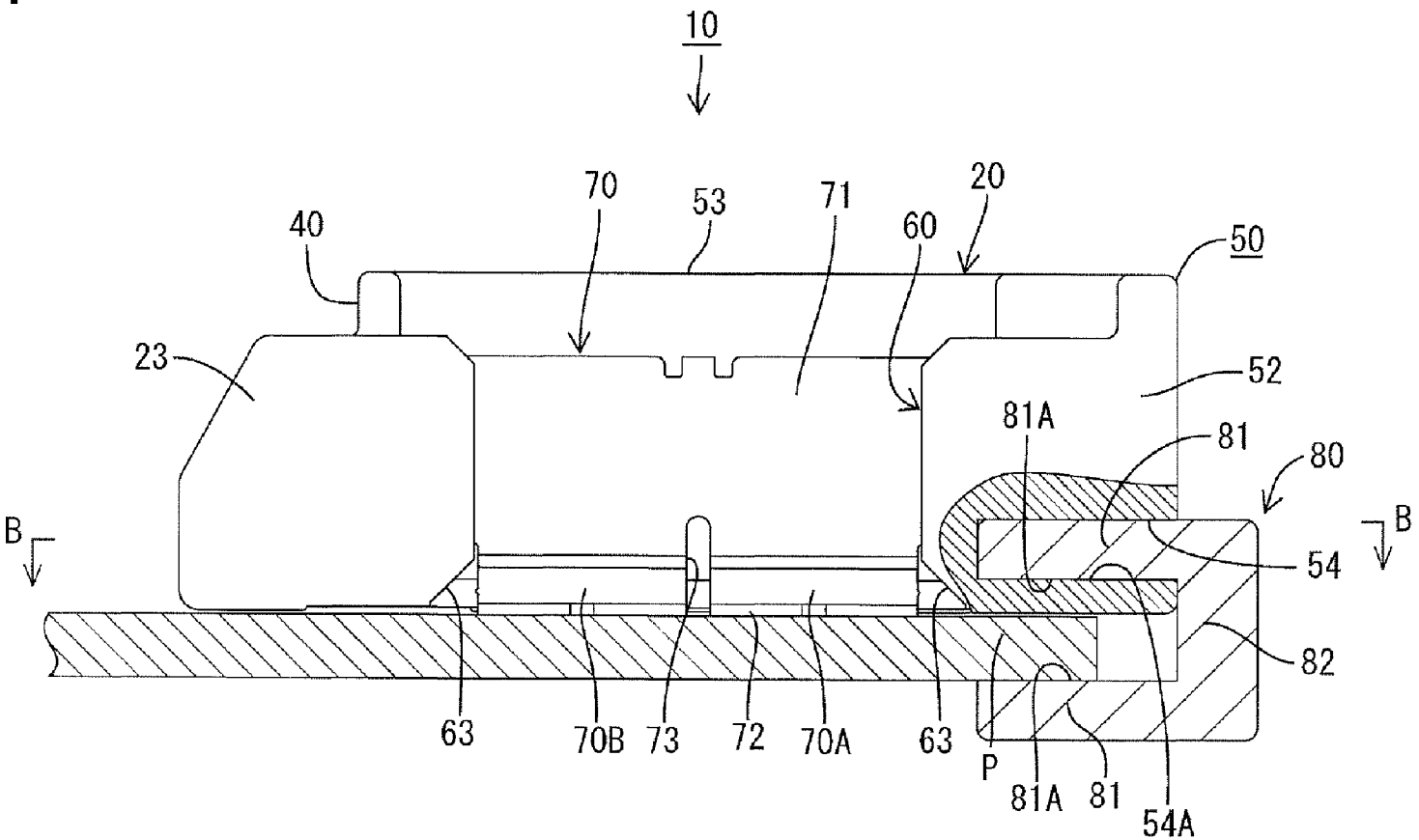
FIG. 4 is a side view partly in section of the board connector showing a state after the restricting members are mounted.

The facing portions 81 of the restricting members 80 then are mounted on the side walls 52 from the front until the front ends of the facing portions 81 contact the rear ends of the mounting portions 54, as shown in FIG. 6 Thus, the upper facing surface 81A engages the lower surface 54A of the mounting portion 54 and the lower facing surface 81A engages the lower surface of the printed board P, as shown in FIG. 4. As a result, the lower surface 54A of the mounting portion 54 and the corresponding part of the printed circuit board P are sandwiched tightly and resiliently held between the facing portions 81 of the restricting member 80. At this time, the front edge of the printed board P is behind the front edge of the receptacle 50 so that the front edge of the printed board P and the connecting portion 82 do not touch each other. The restricting members 80 prevent the front edge of the receptacle 50 from separating from the upper surface of the printed board P to reduce stress on the soldered parts of the soldering portions 72.

The board connector 10 then is accommodated at least partly in the case and the mating connector is connected with the board connector 10 from outside of the case. The lock arm engages the lock 21 when the connectors are connected properly to hold the connectors in a properly connected state. Wires are drawn out from the rear end of the mating connector and may be shaken vertically. However, the restricting members 80 are formed separately from both the connector 10 and the mating connector and prevent the printed board from moving vertically in response to forces exerted on or by the wires. Further, the restricting members 80 prevent the board connector 10 from being separated from the upper surface of the printed board P even if the mating connector receives a force in a direction away from the upper surface of the printed board P. Therefore, stresses on the soldered soldering portions 72 is reduced.

As described above, the restricting members 80 prevent the receptacle 50 from being separated from the upper surface of the printed board P despite receiving a force in a direction away from the upper surface of the printed board P before connection with the mating connector. The wire of the mating connector may be shaken vertically after connection with the mating connector. However, the restricting members 80 prevent the front edge of the receptacle 50 from being separated from the upper surface of the printed board P. The restricting members 80 are separate from the mating connector. Hence, there is no likelihood that the restricting members 80 directly receive an external force from the mating connector that might move the printed board P vertically. Therefore, the printed board B cannot move vertically and stress on the soldered soldering portions 72 is reduced.

The terminal holding portion 40 can be fixed directly by the board fixing portions 70 so that the terminals 30 held in the terminal holding portion 40 are not subjected to a force. On the other hand, the board fixing portions 70 are less able to the front edge of the receptacle 50 on the printed board P as the board fixing portions are positioned closer to the terminal holding portion 40. However, the front edge of the receptacle 50 is fixed by the restricting members 80, and the entire housing 20 can be fixed efficiently.

Each restricting member 80 is comprised of the connecting portion 82 and the two fixing portions 81 and can be easily formed. Further, the receptacle 50 is a substantially rectangular tube comprised of the bottom wall 51, the side walls 52 and the ceiling wall 53. Furthermore, the board fixing portions 70 and the restricting members 80 are arranged at both side walls 52 so that the entire housing 20 can be fixed in a well-balanced manner at the side walls 52.

The present invention is not limited to the above described and illustrated embodiment. For example, the following embodiments are also included in the technical scope of the present invention.

The mounting portions 54 open in the inner surfaces of the side walls 52 in the above embodiment. However, they may openings only in the front ends of the side walls 52 without opening in the inner surfaces of the side walls 52 according to the invention.

Rear ends of the board fixing portions 70 overlap with the terminal holding portion 40 in forward and backward directions in the above embodiment. However, they may be arranged before the terminal holding portion 40.

The restricting member 80 has two fixing portions 81 and the connecting portion 82. However, the second fixing part may be a substantially U-shaped leaf spring according to the present invention.

The receptacle 50 need not be a rectangular tube and can be any shape with side walls 52.

The board fixing portion 70 and the restricting member 80 may be arranged at only one side wall 52 according to the present invention.

What is claimed is:

1. A connector connectable with a mating connector in a state fixed to a fixing surface of an electric device, comprising:

a housing with opposite front and rear ends, the housing including a terminal holding portion for holding one or more terminals and a receptacle projecting from the terminal holding portion to the front end of the housing;

at least one mount groove formed in a side wall of the housing;

at least one first fixing part to be held at least partly in the mount groove within a thickness range of the side wall and to be fixed to the fixing surface of the electric device;

at least one mounting portion formed in the side wall and being open at the front end of the housing; and at least one second fixing part formed separately from the mating connector, the second fixing part having a connecting portion with opposite ends and first and second opposed facing portions extending from the respective ends of the connecting portion, the first and second opposed facing portions respectively having first and second free ends opposite the connecting portion and first and second facing surfaces extending respectively from the first and second free ends to the connecting portion, the first facing portion being mounted in a thickness range of the side wall so that the first free end is in the mounting portion and the facing surface is engageable with an electric device side surface of the mounting portion and the second end facing portion is engageable with the surface of the electric device opposite the fixing surface.

2. The connector of claim 1, wherein the at least one second fixing part is to be mounted within the thickness range of the side wall forward of the first fixing part.

3. The connector of claim 1, wherein the rear end of a first fixing part is arranged to at least partly overlap with the terminal holding portion in forward and backward directions.

4. The connector of claim 1, wherein at least one downwardly open slit is formed in a lower part of the first fixing part.

5. The connector of claim 1, wherein the receptacle includes a bottom wall to be held at least partly in contact with the fixing surface of the electric device, two side walls standing up substantially from the opposite lateral edges of the bottom wall and a ceiling wall connecting the upper ends of the side walls.

6. The connector of claim 5, wherein the first and second fixing parts are arranged for each of the pair of side walls.

7. The connector of claim 6, wherein the side walls have substantially the same thickness as the sum of the thickness of the corresponding portion of the electric device and that of the bottom wall.

8. A connector connectable with a mating connector in a state fixed to a fixing surface of an electric device, comprising:

a housing including a terminal holding portion for holding one or more terminals and a receptacle projecting from the terminal holding portion;

at least one mount groove formed in a side wall of the housing;

at least one first fixing part to be held at least partly in the mount groove within a thickness range of the side wall and to be fixed to the fixing surface of the electric device (P);

at least one mounting portion formed in the side wall and having an open front end;

at least one second fixing part formed separately from the mating connector, to be mounted in a thickness range of the side wall, and having a first end engageable with an electric device side surface of the mounting portion and a second end engageable with the surface of the electric device opposite the fixing surface; wherein a front end of the second fixing part comes into contact with a rear end of the mounting portion.

9. A board connector for use with a printed board having opposite top and bottom surfaces, the board connector comprising:

a housing with opposite front and rear ends, a terminal holding portion rearward of the front end and configured for holding terminals, a receptacle extending from the terminal holding portion to the front end of the housing, the receptacle having a bottom wall with a lower surface for mounting in opposed relation to the top surface of the printed board and first and second opposed side walls projecting up from the bottom wall, first and second mount grooves formed respectively in the first and second side walls of the housing and aligned normal to the bottom wall and extending to the lower surface of the bottom wall, first and second mounting portions extending rearwardly in the respective first and second side walls and being open at the front end of the housing;

first fixing parts held respectively in the mount grooves and configured to be fixed to the top surface of the printed board;

second fixing parts each having a first leg configured to be mounted respectively in one of the mounting portions and a second leg engageable with the bottom surface of the printed board;

a front end of the first leg of the second fixing part being in the mounting portion.

10. The board connector of claim 9, wherein a rear end of the first fixing part at least partly overlap with the terminal holding portion in forward and backward directions.

11. The board connector of claim 9, wherein each of the second fixing parts includes a connecting portion connecting legs.

12. The board connector of claim 9, wherein the side walls have a thickness substantially equal to sum of thicknesses of the printed board and the bottom wall.

13. The board connector of claim 9, wherein a front end of the second fixing part contacts a rear end of the mounting portion.

* * * * *